United States Patent [19]

Savage et al.

[11] 4,245,957

[45] Jan. 20, 1981

[54] BLADED FAN ASSEMBLY AND COMPRESSION LOADED CONNECTOR

[75] Inventors: Jack W. Savage, Centerville; Ned L. Kikly, Vandalia, both of Ohio

[73] Assignee: General Motors Corporation, Detroit, Mich.

[21] Appl. No.: 961,610

[22] Filed: Nov. 17, 1978

[51] Int. Cl.[3] ..... F04D 29/20

[52] U.S. Cl. ..... 416/135; 416/214 R; 416/241 A

[58] Field of Search ..... 416/135, 169 A, 241 A, 416/214 R, 244 B, 229 R, 134 R, 230 R

[56] References Cited

U.S. PATENT DOCUMENTS

| | | | |
|---|---|---|---|
| 2,632,354 | 3/1953 | Black | 416/244 B X |
| 2,653,459 | 9/1953 | Morrill | 416/134 R X |
| 2,773,365 | 12/1956 | Delf et al. | 416/134 R X |
| 2,853,140 | 9/1958 | Forth | 416/134 R |
| 3,005,497 | 10/1961 | Klonoski et al. | 416/214 R X |
| 3,084,852 | 4/1963 | Seavey | 416/134 |
| 3,245,476 | 4/1966 | Rodwick | 416/244 B X |
| 3,409,489 | 11/1968 | Renton | 416/214 R |
| 3,612,719 | 10/1971 | Nomura | 416/135 X |
| 3,656,785 | 4/1972 | Lothar | 403/370 |
| 4,009,970 | 3/1977 | Forth | 416/134 R |

FOREIGN PATENT DOCUMENTS

| | | | |
|---|---|---|---|
| 358938 | 9/1922 | Fed. Rep. of Germany | 416/135 |
| 106944 | 6/1917 | United Kingdom | 416/134 |
| 305473 | 3/1930 | United Kingdom | 416/214 R |

*Primary Examiner*—Everette A. Powell, Jr.
*Attorney, Agent, or Firm*—Charles R. White

[57] ABSTRACT

Fan blade assembly and shaft mounting in which there is minimized axial face run out or wobble of the rotating fan by virtue of the fan taking a perpendicularity signal from a shaft mounted hub plate which divorces the squareness of the fan shaft opening from influencing the hub plate perpendicularity signal. The fan is mounted on the motor shaft by a nut and Belleville spring assembly to provide end play takeup by the load deflection characteristic of the Belleville spring.

3 Claims, 2 Drawing Figures

BLADED FAN ASSEMBLY AND COMPRESSION LOADED CONNECTOR

Figure 1:
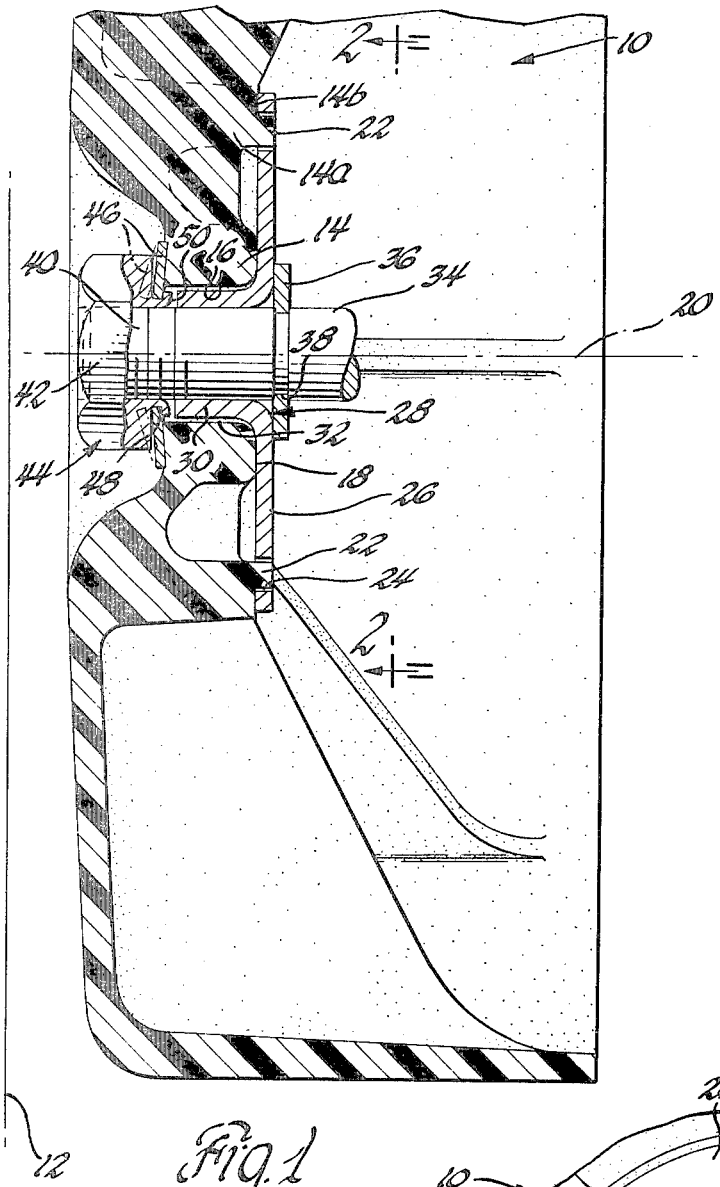

This invention relates to a new and improved bladed fan assembly compressively loaded by a spring device into a predetermined position on a shaft for rotation therewith in a plane perpendicular to the axis thereof for reduced fan wobble.

In some compact automobiles, the liquid cooled internal combustion engine is transversely mounted in the engine compartment for improved space utilization. The radiators for such engines are generally mounted in a forward position to permit ram air to flow therethrough for cooling the liquid circulated through the radiator. With such transverse engines, the primary radiator cooling fan mounted behind the radiator is generally driven by an electric motor to eliminate the need for a complex drive train from the engine to the fan. Generally such cooling fans are molded from a plastic material and mounted on the drive shaft of the motor. Prior to the present invention, difficulties were encountered with such fans since they would often have excessive run out or wobble when driven. Excessive fan wobble generated excessive vibration and necessitated a requirement for increased clearance between the fan and the radiator. This increased clearance allowed large quantities of air to bypass the radiator which resulted in reduced radiator cooling efficiency. To correct excessive fan wobble, a fan having a metallic internally-threaded arbor, imbedded into the plastic hub of the fan, was employed to mount the fan onto the end of the output shaft of the motor. This construction was not satisfactory for quantity production in view of the need to precisely locate the arbor at the exact center of the fan hub and to axially orient the arbor so that the fan blading would not wobble and strike the radiator.

Accordingly, it is a feature, object and advantage of this invention to provide a new and improved drive coupling for drivingly connecting a cooling fan to an output shaft so that the fan rotates with minimum vibration in a plane adjacent to a radiator without physical contact therewith.

Another feature, object and advantage of this invention is to provide a new and improved cooling fan mounting providing minimized fan blade wobble or run out by virtue of precisioned fan location dictated by a signal from a shaft mounted hub member which divorces the squareness of a centralized opening in the fan hub from influencing the hub plate perpendicularity signal.

It is another feature, object and advantage of this invention to provide a new and improved bladed fan assembly for drawing air through a radiator in which a fan mount is positioned on the cylindrical shaft of a drive motor and which incorporates a combination locknut and Belleville spring assembly that compressively loads the fan against a base plate mounted on the drive shaft so that the fan blade assembly is driven by the shaft for rotation in a plane which is perpendicular to the axis of the shaft and preferably parallel to the plane of the inner face of a radiator.

It is another feature, object and advantage of this invention to provide a new and improved compression loading connector device for use on a driven fan blade or the like which incorporates a Belleville spring that seats on an element of the driven device and which is flattened in response to predetermined torquing of the connector device nut so that a known load deflection characteristic is met when connecting two devices together.

It is another feature, object and advantage of this invention to provide a new and improved fan blade assembly in which the fan blade is coupled to a drive shaft from a motor and in which the fan blading is commanded to rectitude by a Belleville washer when a fastener nut of a connector device is screwed onto a shaft on which the fan blade is mounted.

Figure 2:
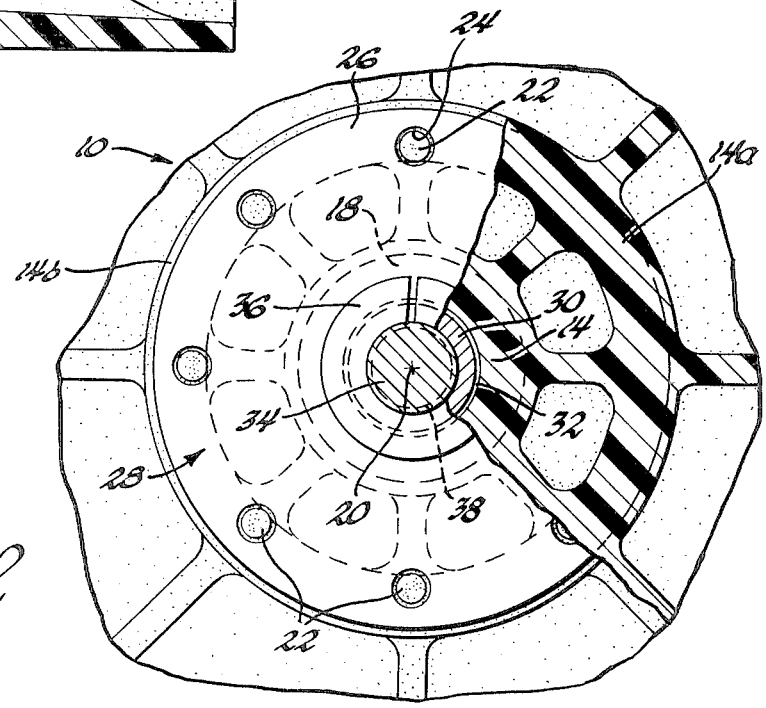

These and other features, objects and advantages of this invention will be more apparent from the following detailed description and drawings in which:

FIG. 1 is a side view partly in cross section of a portion of a fan blade assembly and drive shaft; and FIG. 2 is a view taken along lines 2—2 of FIG. 1.

Turning now in greater detail to the drawings, FIG. 1 shows a bladed engine cooling fan 10 molded from nylon or other suitable material for drawing air through the core of a conventional vehicle radiator having an inner end which lies in a plane through line 12 perpendicular to the drawing paper. The fan has an inner annular hub 14 in which a cylindrical opening 16 is centrally formed. The fan has an outer annular hub **14*a* which has a flat rear locator surface 14*b* extending around the inboard end of opening 16 which is perpendicular to the rotational axis 20 of the fan. Disposed radially outwardly of locator surface 14*b* is a ring of equally spaced cylindrical projections 22 that extend axially and rearwardly from the hub of the fan. These projections are adapted to fit in corresponding circular openings 24 in the annular flat base plate 26 of a metallic fan mount 28. This base plate has a cylindrical hub 30 which projects axially into the opening 16 and which has an axis coinciding with rotational axis 20. The internal diameter of the cylindrical opening 16 is greater than the external diameter of the mounting plate hub 30 to provide annular clearance 32 so that the mounting plate hub 30 can be disposed within opening 16 when the fan is mated to plate 26 without binding or fight permitting the physical engagement of locator surface 14*b* with corresponding interface portions of the base 26 with the simultaneous insertion of the projections 22 into the openings 24 of the base. With the hub 30 of the mounting plate tightly fitting onto the shaft 34 and with base 26 abutted against the locater surface 14*b* and with the projections 22 extending through openings 24, the fan as installed on cylindrical drive shaft 34 assumes a predetermined degree of vertical rectitude with respect to axis 20. It is essential for vertical rectitude control that annular fan hub faces 14*b* and 18** be coplanar.

Drive shaft 34 preferably is the output of a conventional permanent magnet motor which carries, for convenience of assembly only, a split retainer ring 36 mounted in an annular groove 38 formed therein. The groove and cooperating retainer ring are perpendicular to the axis of the drive shaft so that the ring 36 forms a perpendicular stop for the base plate 26 when installed on shaft 34 by press fitting or shrinking. As indicated by the drawing, the fan hub 14 is compressively loaded against the mounting plate base 26. To this end, the drive shaft 34 is threaded at 40 to threadedly receive an annular internally threaded nut 42 of a Belleville spring and nut assembly 44. The Belleville spring 46 is in its undeflected state a coned metallic spring member as indicated by phantom lines in FIG. 1. This spring is mounted for free spinning on the nut and has a central opening coaxial with the threaded opening in the nut that receives the cylindrical shoulder 48 of the nut. The spring 46 is retained on the shoulder by radially upsetting or coining the outer end of the shoulder as indicated at 50. When the assembly 44 is installed on the threaded end of shaft 34, the spring 46 is disposed against the outer face of the hub portion of the fan. When the nut 42 is tightened to a predetermined torque the spring 46 will flatten as shown in solid lines in FIG. 1 thereby appraising the installer that a proper and predetermined torque has been applied to the nut and a predetermined compression load has been applied to the fan assembly. For example, in one installation a nut torque of 17.6 in.-lbs. was required to flatten the spring which exerted a compression load of 282 lbs. on the fan hub producing a compressive stess of 1000 psi in the fan hub section. With this compression load, the fan assembly is drivingly secured to shaft 34 being trapped between the base plate 26 and the Belleville spring 46.

On appropriate torquing of the nut and flattening of the spring 46, it will be appreciated that the fan will be secured to the drive shaft 34 for rotation therewith without appreciable loss of axial tightness with respect to creep of the plastic material of the fan hub. Importantly, with this invention, the center hole 16 in the plastic fan does not have to be maintained as concentric with the rotational axis 20 or even be of any particular formation so long as it receives mounting plate hub 30 with clearance since the mounting plate with closely controlled perpendicularity itself is used to dictate the perpendicularity of the fan blades with the drive shaft. With such perpendicularity assured, the fan can be located in close proximity to the inner face of the radiator such as represented by line 12 allowing the fan to efficiently draw air through the radiator for engine cooling purposes. Without such perpendicularity, the fan has to be located at a further and thereby a more ineffective distance from the radiator so that fan run out or wobble cannot cause damage to the radiator through the striking of the radiator by the rotating fan blades.

The embodiments of the invention in which an exclusive property or privilege is claimed are defined as follows:

1. A bladed fan assembly mounted on a cylindrical shaft rotatable about a longitudinal axis comprising a bladed fan having a hub with a central opening therein, a stop member secured in axial position on the shaft, a metallic fan mount having a cylindrical hub portion operatively mounted on said shaft and having a base plate extending from one end of said hub portion substantially perpendicular to the axis of said shaft, said base plate having a plurality of openings therein disposed in a pattern about one end of said hub portion, said hub portion of said mount projecting freely into said central opening of said fan hub with a discrete annular clearance therebetween, said fan having a plurality of projections which are selectively engaged in said openings of said base plate, said hub portion of said fan having a radially extending wall which contacts the inner surface of said base plate to establish the transverse position of said fan relative to said longitudinal axis of said shaft and the plane of fan rotation thereby minimizing wobble or run out of the fan when rotating about said axis, and compression spring means for compressively loading said fan hub against said base plate and securing said fan for rotating in a plane substantially perpendicular to the axis of said shaft.

2. A bladed fan and drive coupling therefor comprising a rotatable drive shaft having a longitudinal centralized axis of rotation, stop means carried by said drive shaft and spaced a fixed axial distance from the outer end thereof, a metallic fan mount having a hub portion mounted on said drive shaft and having a radially extending flange disposed around said axis and having a flat support face that is substantially perpendicular to said axis of rotation, a bladed fan having a hub with an enlarged central opening receiving said hub portion of said fan mount with discrete annular clearance therebetween, and fan centering means operatively connecting said flange to said hub portion of said fan disposed radially outwardly of said hub portion of said mount, said hub portion of said fan having a flat locator surface concentric with said axis, and compression spring means mounted on the outer end of said drive shaft for compressively loading said locator surface of said hub into squared engagement with said support face to thereby drivingly connect said fan to said drive shaft and to orient said fan assembly for rotation in a plane substantially perpendicular to the rotational axis of said shaft.

3. A fan assembly mounted on a cylindrical shaft rotatable about a longitudinal axis extending centrally through said shaft comprising a bladed fan having a hub with a central opening therein, a metallic fan mount having a cylindrical hub portion operatively mounted on said shaft inwardly of one end thereof, and projecting into said opening with discrete annular clearance therebetween, said fan mount having an integral base plate extending radially from said hub portion substantially perpendicular to and around said longitudinal axis of said shaft, said base plate having a flat inner surface perpendicular to said axis and a plurality of openings therein disposed about said hub portion, stop means associated with said shaft for engaging said fan mount to extablish the position of fan mount on said shaft, said fan having a plurality of projections which are selectively engaged in said openings of said base plate, said hub portion of said fan having a radially extending wall disposed around said axis which annularly contacts the inner surface of said base plate to establish the transverse position of said fan and the plane of fan rotation relative to said longitudinal axis of said shaft thereby minimizing wobble or run out of the fan when rotating about said axis, and compression means adjustably mounted on said one end of said shaft for compressively loading said hub portion of said fan against said flat inner surface of said base plate and thereby securing said fan for rotating in a plane substantially perpendicular to the axis of said shaft.

* * * * *